US008356973B2

(12) United States Patent
Morphet et al.

(10) Patent No.: US 8,356,973 B2
(45) Date of Patent: Jan. 22, 2013

(54) TURBOCHARGER

(75) Inventors: Robert Morphet, West Yorkshire (GB); Robert Holroyd, West Yorkshire (GB); Tim Denholm, Warwickshire (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 402 days.

(21) Appl. No.: 12/731,682

(22) Filed: Mar. 25, 2010

(65) Prior Publication Data

US 2011/0020111 A1 Jan. 27, 2011

(30) Foreign Application Priority Data

Mar. 25, 2009 (GB) ..... 0905038.6

(51) Int. Cl.
*F04D 15/00* (2006.01)

(52) U.S. Cl. ..... 415/157; 415/158; 415/186; 415/190; 60/602

(58) Field of Classification Search ..... 415/157, 415/158, 159, 183, 185, 186, 200; 60/602
See application file for complete search history.

(56) References Cited

U.S. PATENT DOCUMENTS

| | | | | |
|---|---|---|---|---|
| 4,499,732 | A * | 2/1985 | Szczupak et al. | 415/158 |
| 4,973,223 | A * | 11/1990 | Franklin | 415/157 |
| 5,044,880 | A * | 9/1991 | McKean | 415/158 |
| 6,401,563 | B1 * | 6/2002 | Franklin | 415/157 |
| 6,776,574 | B1 * | 8/2004 | Parker | 415/158 |
| 2010/0119355 | A1 * | 5/2010 | Cox | 415/15 |

FOREIGN PATENT DOCUMENTS

| | | |
|---|---|---|
| GB | 2 218 745 A | 11/1989 |
| WO | WO 2009/010711 | 1/2009 |

OTHER PUBLICATIONS

United Kingdom Search Report GB0905038.6, Cummins Turbo Technologies Limited, Jul. 22, 2009.

* cited by examiner

*Primary Examiner* — Igor Kershteyn
(74) *Attorney, Agent, or Firm* — Krieg DeVault LLP

(57) ABSTRACT

According to an aspect of the present invention, there is provided a variable geometry turbine comprising: a turbine wheel mounted on a turbine shaft within a housing assembly for rotation about a turbine axis, the housing assembly defining a gas flow inlet passage upstream of the turbine wheel; an annular wall member defining a wall of the inlet passage and which is displaceable in a direction substantially parallel to the turbine axis to control gas flow through the inlet passage; at least one moveable rod operably connected via a first end of the rod to the annular wall member, the rod being moveable to control displacement of the annular wall member, the rod extending in a direction substantially parallel to the turbine axis, the rod being connected to the annular wall member via a first arm and a second arm, a first end of the first arm and a first end of the second arm being attached to the rod, and a second end of the first arm being attached to the annular wall member at a first circumferential position, and a second end of the second arm being attached to the annular wall member at a second, different circumferential position, the first arm and the second arm being resilient in order to allow relative movement between the first end of the rod and the annular wall member during expansion of the annular wall member.

22 Claims, 7 Drawing Sheets

TURBOCHARGER

CROSS REFERENCE TO RELATED APPLICATIONS

Figure 1:
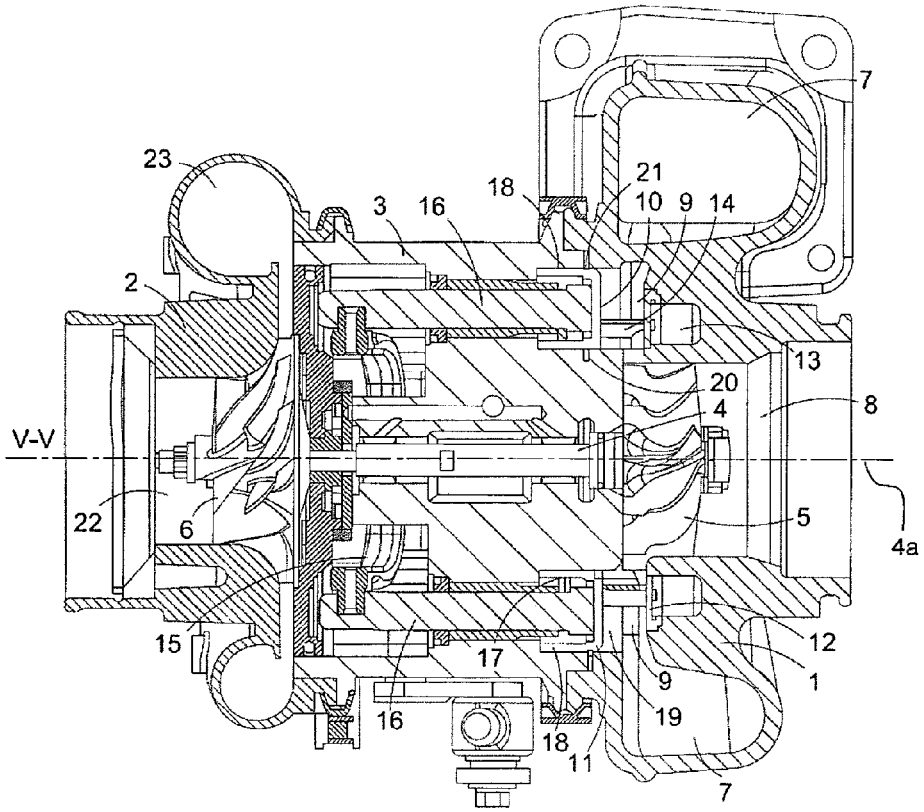
FIG. 1 PRIOR ART

The present application claims priority to United Kingdom Patent Application No. 0905038.6 filed Mar. 25, 2009, which is incorporated herein by reference.

The present invention relates to a variable geometry turbine. The variable geometry turbine may, for example, form a part of a turbocharger.

Turbochargers are well known devices for supplying air to an intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine intake manifold. The turbocharger shaft is conventionally supported by journal and thrust bearings, including appropriate lubricating systems, located within a central bearing housing connected between the turbine and compressor wheel housings.

In known turbochargers, the turbine stage comprises a turbine chamber within which the turbine wheel is mounted; an annular inlet passageway defined between facing radial walls arranged around the turbine chamber; an inlet volute arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. It is also known to improve turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine, an axially moveable wall member, which is sometimes referred to as a "nozzle ring", defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output.

The nozzle ring may be provided with vanes which extend into the inlet and through slots provided in a "shroud" defining the facing wall of the inlet passageway to accommodate movement of the nozzle ring. Alternatively vanes may extend from the fixed facing wall and through slots provided in the nozzle ring.

Typically the nozzle ring may comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring. In one common arrangement the nozzle ring is supported on, or is supported by, rods (sometimes referred to as "pushrods", "push-rods" or "push rods") extending parallel to the axis of rotation of the turbine wheel (i.e. the turbine axis). The nozzle ring is moved by an actuator assembly which axially displaces the rods.

An example of such a known actuator assembly is disclosed in U.S. Pat. No. 5,868,552. A yoke is pivotally supported within the bearing housing and defines two arms, each of which extends into engagement with an end of a respective nozzle ring support rod. The yoke is mounted on a shaft journaled in the bearing housing and supporting a crank external to the bearing housing which may be connected to an actuator in any appropriate manner. Each arm of the yoke engages an end of a respective support rod via a block which is pivotally mounted to the end of the yoke on a pin and which is received in a slot defined by the rod which restrains the block from movement along the axis of the rod but allows movement perpendicular to the axis of the rod. An actuator is controlled to pivot the yoke about its support shaft via the yoke crank which in turn causes ends of the yoke arms to describe an arc of a circle. Engagement of the yoke arms with the nozzle ring support rods moves the rods back and forth along their axis. Off axis movement of the yoke arms is accommodated by the sliding motion of the blocks within the slots defined by support rods.

The actuator which moves the yoke can take a variety of forms, including pneumatic, hydraulic and electric forms, and can be linked to the yoke in a variety of ways. The actuator will generally adjust the position of the nozzle ring under the control of an engine control unit (ECU) in order to modify the airflow through the turbine to meet performance requirements.

In use, the nozzle ring of a variable geometry turbine is subjected to high temperatures. The high temperatures cause expansion of the nozzle ring. If the rods which support the nozzle ring are fixed in position on the nozzle ring, expansion of the nozzle ring will cause the rods to move apart from one another. It is common to provide one or more guides for supporting the rods and/or guiding movement of the rods. The guides may take the form of, for example, bushes or the like. Alternatively or additionally, the guides may be one or more bores in a bearing house through which the rods extend and through which the rods are moveable. To ensure reliable operation of the variable geometry turbine, there is usually very little clearance between the rods and their respective guides. Thus, when the rods are pushed apart from one another due to expansion of the nozzle ring, the rods are pushed against the guides with a large amount of force. This is because the guides do not move at all in the direction of movement of the rods, or move to the same extent as the rods. For instance, the thermal expansion of the bearing housing may be insignificant, or not as significant as the expansion of the nozzle ring, meaning that the guides in the bearing housing (e.g. bores) do not move apart from one another to the same extent as the rods.

When the rods push against and apply large forces to the respective guides, problems can arise. For instance, the large forces may damage the rods or the guides, or alternatively or additionally cause the rods to become stuck within the guides. It is desirable to avoid damage to the rods or guides, and to reduce or eliminate the chances of the rods becoming stuck within the guides as a consequence of the expansion of the nozzle ring.

It is an object of the present invention to provide a variable geometry turbine which obviates or mitigates one or more of the problems associated with existing variable geometry turbines, whether identified herein or elsewhere.

According to an aspect of the present invention, there is provided a variable geometry turbine comprising: a turbine wheel mounted on a turbine shaft within a housing assembly for rotation about a turbine axis, the housing assembly defining a gas flow inlet passage upstream of the turbine wheel; an annular wall member defining a wall of the inlet passage and which is displaceable in a direction substantially parallel to the turbine axis to control gas flow through the inlet passage; at least one moveable rod operably connected via a first end of the rod to the annular wall member, the rod being moveable to control displacement of the annular wall member, the rod extending in a direction substantially parallel to the turbine axis, the rod being connected to the annular wall member via a first arm and a second arm, a first end of the first arm and a first end of the second arm being attached to the rod, and a second end of the first arm being attached to the annular wall member at a first circumferential position, and a second end of the second arm being attached to the annular wall member at a second, different circumferential position, the first arm and the second arm being resilient in order to allow relative movement between the first end of the rod and the annular wall member during expansion of the annular wall member.

If the rod was directly attached to the nozzle ring, the problems discussed above would not be obviated or mitigated. According to an embodiment of the present invention, by connecting the rod to the nozzle ring by two resilient arms, relative movement is allowed between the first end of the rod and the annular wall member during expansion of the annular wall member. The resilience of the arms at least partially compensates for the expansion of the annular wall member, thereby, for example, reducing or eliminating the forces imparted on one or more guides of the rod. This may prevent damage to the rod or guide, or reduce or eliminate the chances of the rod becoming stuck within the guide.

The first arm and second arm may be configured such that any movement of the first end of the rod in a direction of expansion of the annular wall member is less than the movement would be if the rod was directly attached to the annular wall member.

The first arm and second arm may be formed from a material (or composition of materials) which has a lower coefficient of thermal expansion than a material forming the annular wall member. The coefficient of thermal expansion of the material forming the arms may be 5-60% less than that of the material forming the nozzle ring. The coefficient of thermal expansion of the material forming the arms may be 15-40% less than that of the material forming the nozzle ring. If the coefficient of thermal expansion of the material forming the arms was any lower, the fatigue in one or more joints between the arms and the nozzle ring may be too high.

Because the arms are formed from a material which has a lower coefficient of thermal expansion than the material forming the annular wall member, the arms do not expand as much as the annular wall member. Since the arms do not expand as much as the annular wall member the position of the rod does not shift as much as it would if the arms were formed of a material having the same coefficient of thermal expansion as the annular wall member. This reduced expansion of the arms further obviates or mitigates the problems that are associated with movement of the rods during the expansion of the nozzle ring.

The annular wall member may extend in a direction parallel to a plane that extends perpendicularly with respect to the turbine axis. For example, the radius of diameter of the annular wall member may extend in a direction parallel to a plane that extends perpendicularly with respect to the turbine axis.

The first arm and the second arm may extend in a direction that is parallel to a plane that extends perpendicularly with respect to the turbine axis.

The first arm and the second arm may be extendable in a direction that is parallel to a plane that extends perpendicularly with respect to the turbine axis.

The first arm and second arm may be configured to be more extendable in a direction that is parallel to a plane that extends perpendicularly with respect to the turbine axis, than in a direction toward or away from that plane.

The first arm and second arm may be stiffer in a direction parallel to the turbine axis than the first arm and second arm are in a direction that is parallel to a plane that extends perpendicularly with respect to the turbine axis.

The first arm and second arm may each have a length in a direction that is parallel to a plane that extends perpendicularly with respect to the turbine axis, a width in a direction parallel to the turbine axis, and a depth perpendicular to the length and width, the width being greater than the depth.

The first arm and second arm may each comprise a curve or a bend, or one or more curves or bends. The curve or bend may extend in a direction that is parallel to a plane that extends perpendicularly with respect to the turbine axis. The curve or bend may be curved or bent relative to a curve or bend axis, the curve or bend axis extending substantially parallel to the turbine axis.

The first arm and second arm may extend in a substantially circumferential direction with respect to the annular wall member.

The rod may be located such that, when the turbine is not in use, a longitudinal axis of the rod extends between a radially outer extent of the annular wall member and a radially inner extent of the annular wall member.

The first arm and second arm may be substantially the same.

The arms may be joined together.

The turbine may comprise a guide configured to guide movement of the rod, and/or to support the rod. The guide may define an aperture through which the rod is moveable.

Two rods may be provided, each rod being connected to the annular wall member via a first arm and a second arm, a first end of the first arm and a first end of the second arm being attached to the rod, and a second end of the first arm being attached to the annular wall member at a first circumferential position, and a second end of the second arm being attached to the annular wall member at a second, different circumferential position. The two rods may be connected to the annular wall member such that the two rods are diametrically opposed with respect to one another. A bridge may be provided that connects the two rods.

The turbine may form part of a turbocharger.

Other advantageous and preferred features of the invention will be apparent from the following description.

Figure 2:
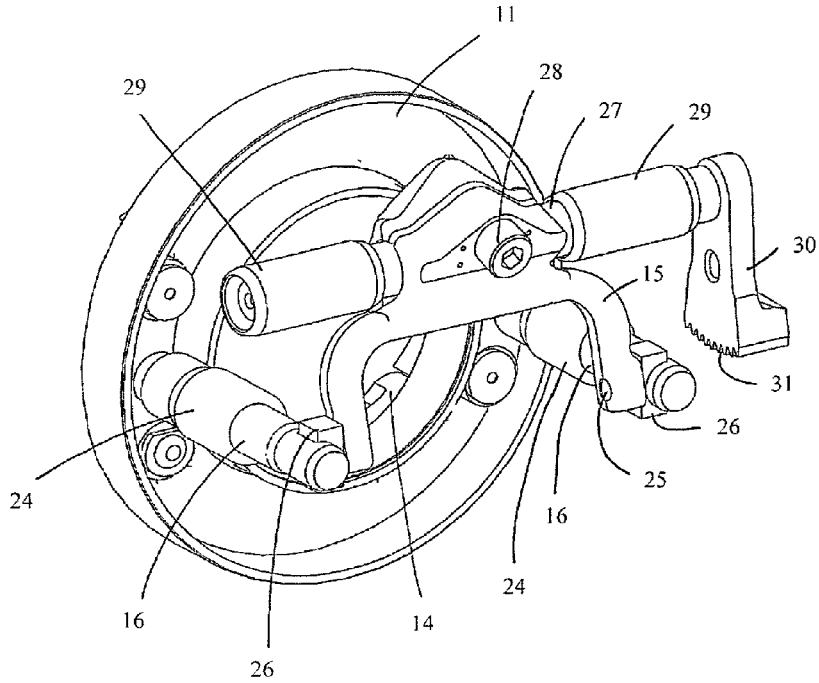
FIG. 2 PRIOR ART
Figure 3:
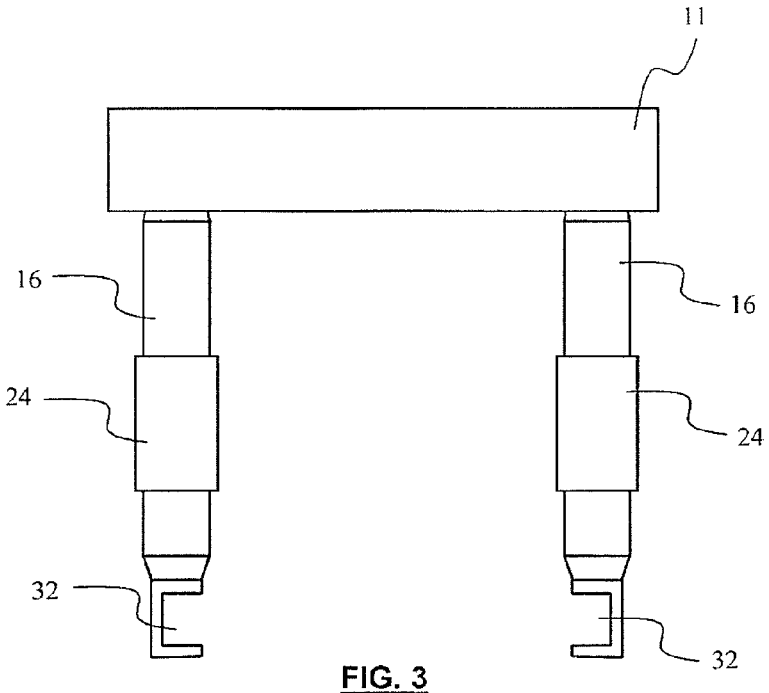
FIG. 3 PRIOR ART
Figure 4:
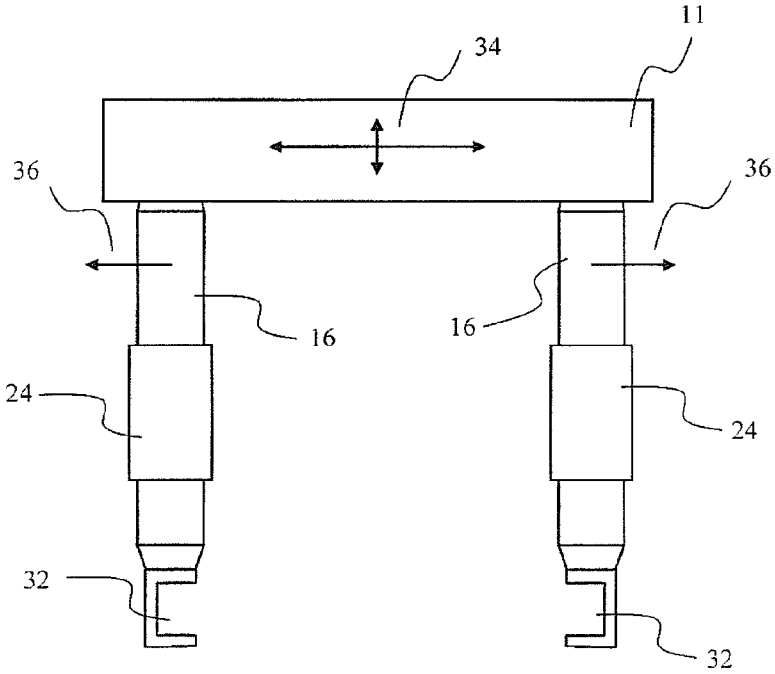
FIG. 4 PRIOR ART
Figure 5:
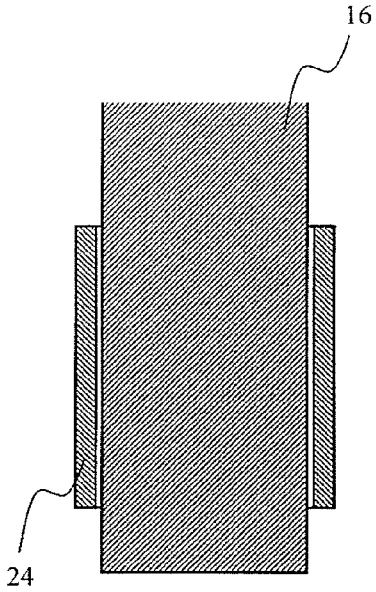
FIG. 5 PRIOR ART
Figure 6:
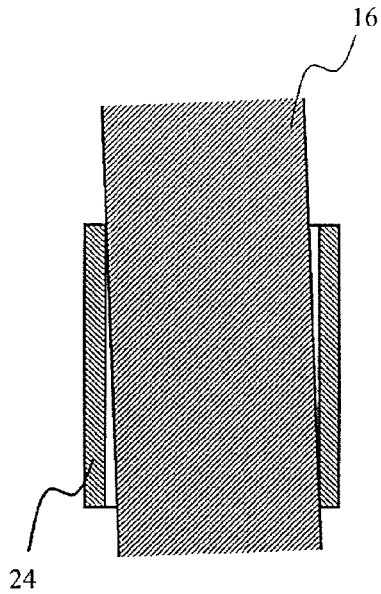
FIG. 6 PRIOR ART
Figure 7:
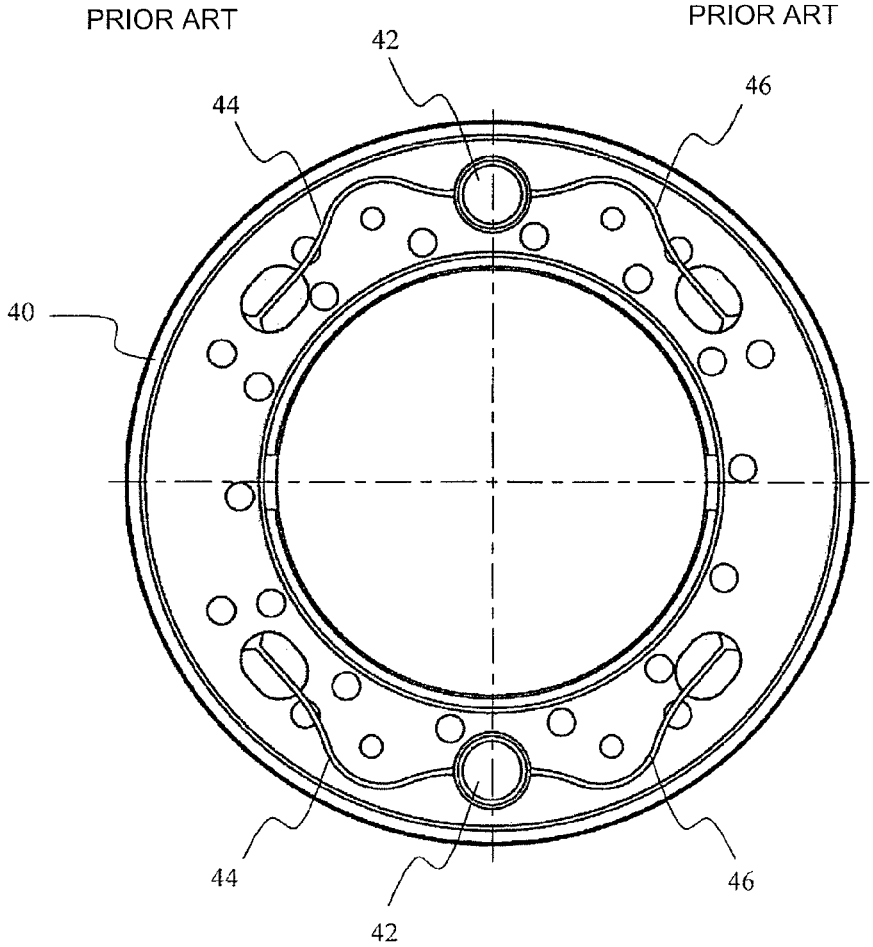
Figure 8:
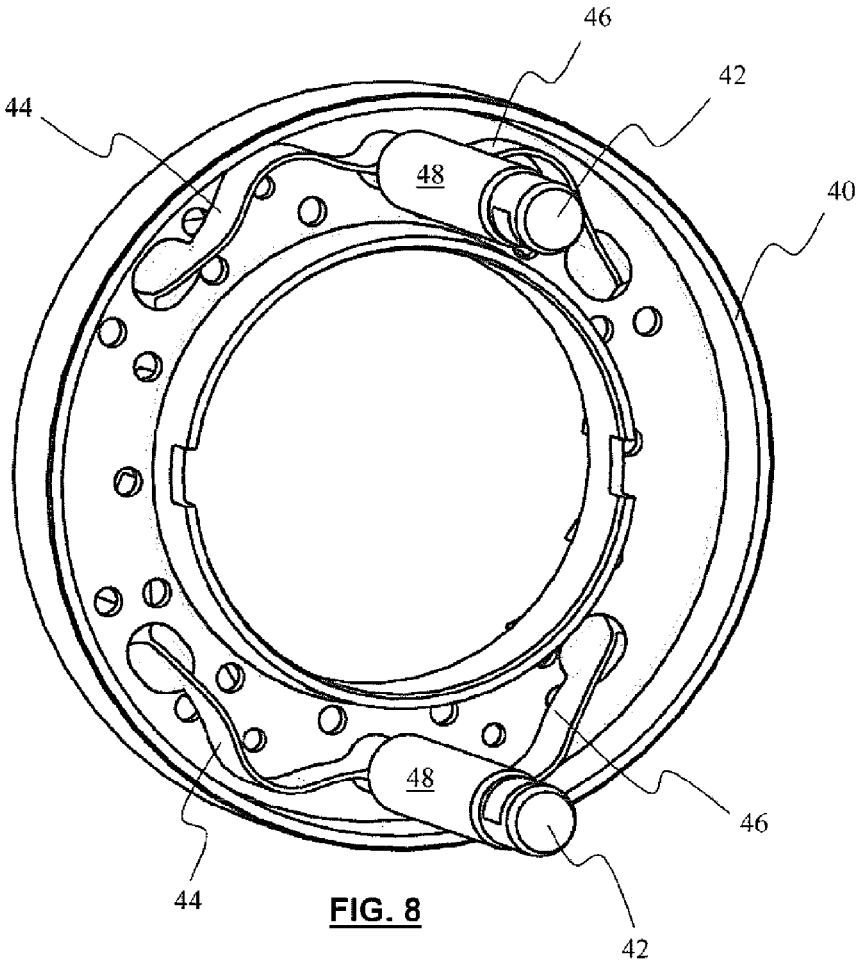
Figure 9:
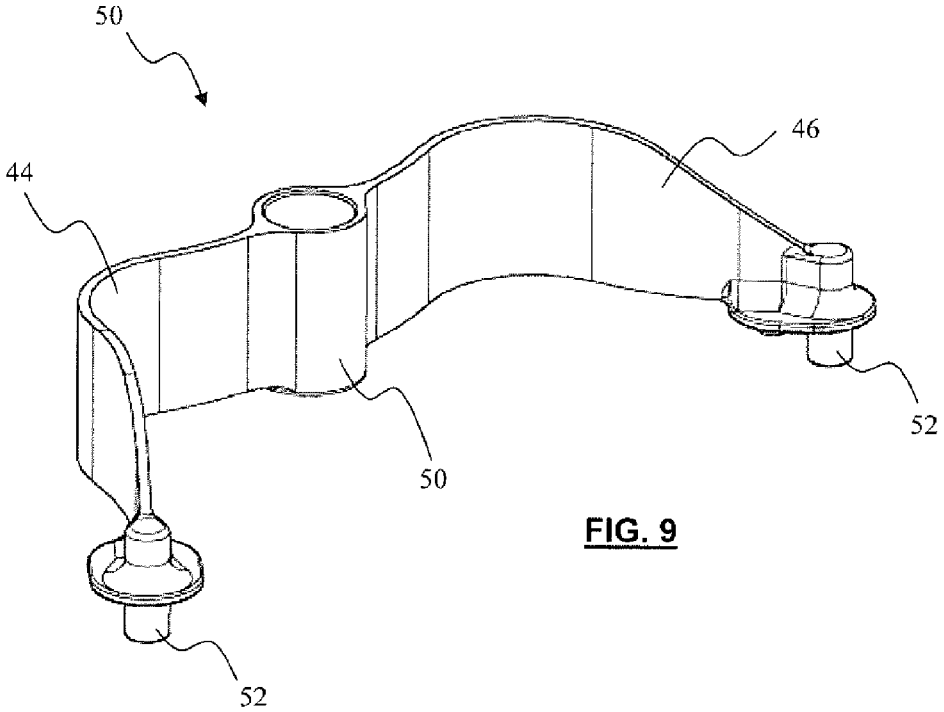
Figure 10:
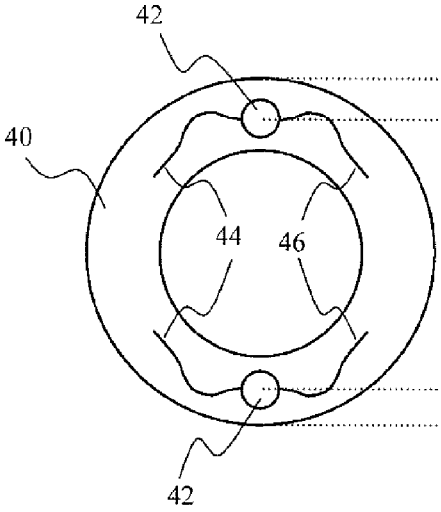
Figure 11:
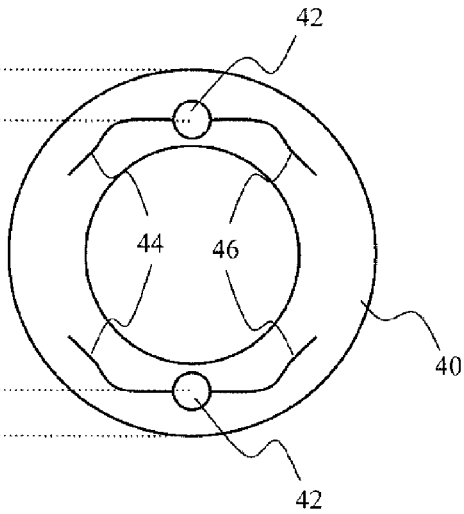
Figure 12:
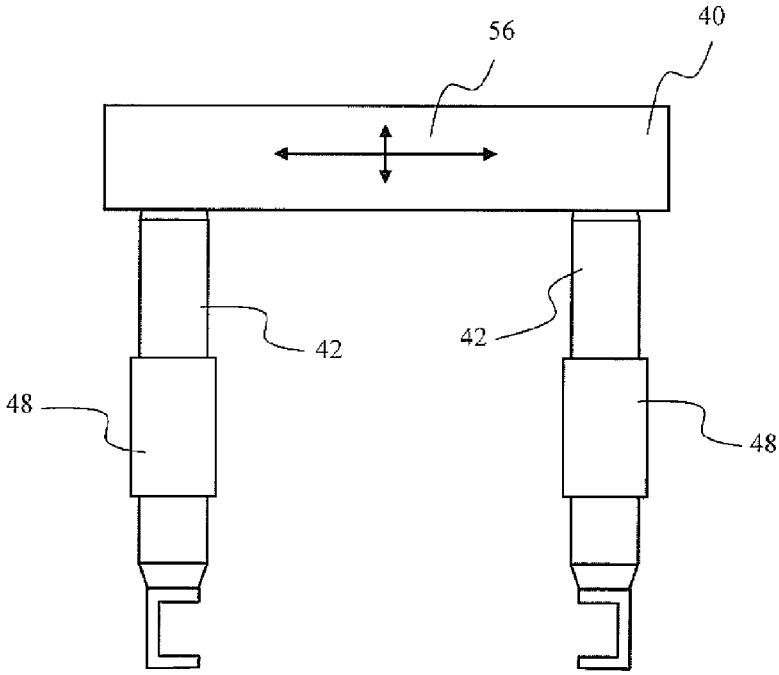
Figure 13:
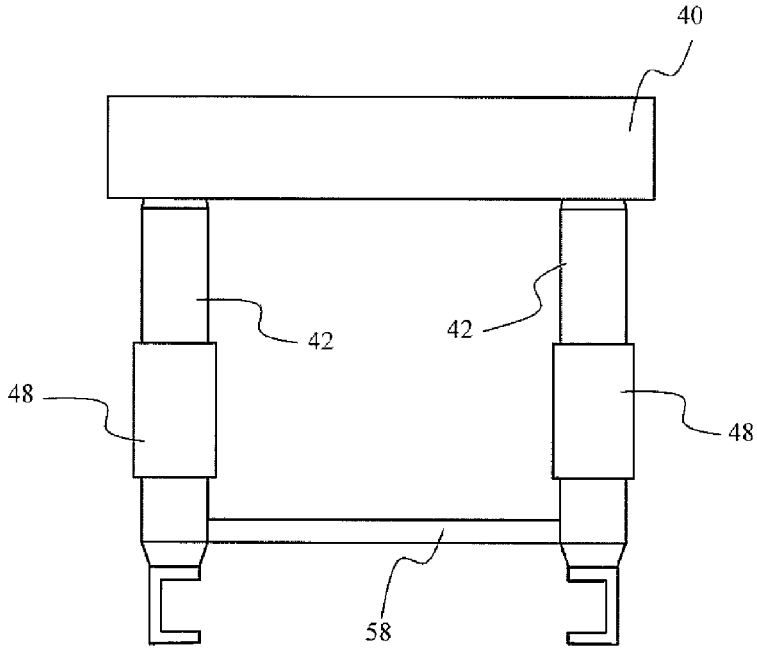
Figure 14:
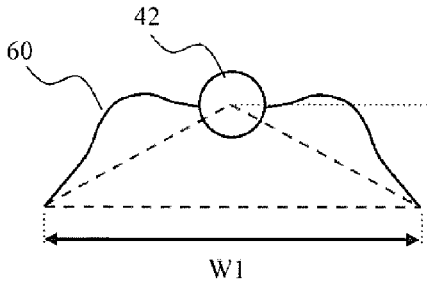
Figure 15:
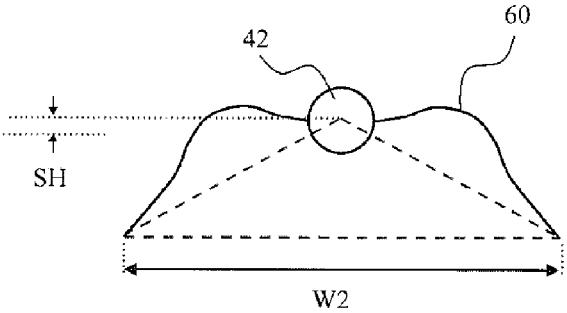
Figure 16:
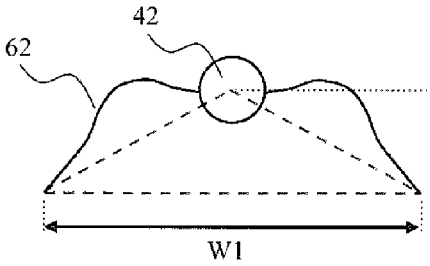
Figure 17:
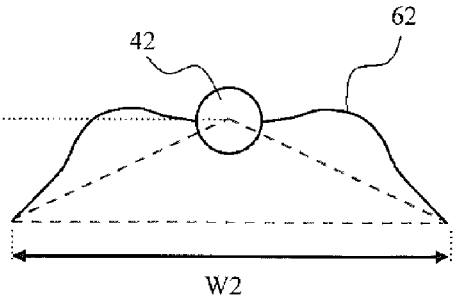

Specific embodiments of the present invention will now be described, by way of example only, with reference to the accompanying Figures, in which:

FIG. 1 schematically depicts an axial cross-section through a known variable geometry turbocharger;

FIG. 2 schematically depicts an enlarged perspective view of components of the nozzle ring actuator assembly of the turbocharger of FIG. 1;

FIG. 3 schematically depicts an enlarged plan view of components of the nozzle ring actuator assembly of FIG. 2;

FIG. 4 schematically depicts the expansion of the nozzle ring shown in FIG. 3, and the effect of this expansion on the position of the rods supporting the nozzle ring;

FIG. 5 schematically depicts a rod extending through a guide;

FIG. 6 schematically depicts a mis-aligned rod relative to a guide;

FIG. 7 schematically depicts an end-on view of a nozzle ring arrangement in accordance with an embodiment of the present invention;

FIG. 8 schematically depicts a perspective view of the nozzle ring arrangement of FIG. 7;

FIG. 9 schematically depicts a bracket, comprising two arms, for connecting a rod to a nozzle ring in accordance with an embodiment of the present invention;

FIG. 10 schematically depicts an end-on view of a nozzle ring arrangement in accordance with an embodiment of a present invention;

FIG. 11 schematically depicts expansion of the nozzle ring of FIG. 10 and the effect of the expansion of the nozzle ring on the positions of rods connected to the nozzle ring;

FIG. 12 schematically depicts, in plan view, a nozzle ring and rods connected to that nozzle ring in accordance with an embodiment of the present invention, and the effect of the expansion of the nozzle ring on the position of the rods;

FIG. 13 schematically depicts, in plan view, a nozzle ring and rods connected to that nozzle ring, together with a bridge connecting together the rods, in accordance with an embodiment of the present invention;

FIG. 14 schematically depicts a rod and the arms that connect the rod to a nozzle ring, in accordance with an embodiment of the present invention;

FIG. 15 schematically depicts an effect of the expansion of the nozzle ring on the position of the rod of FIG. 15;

FIG. 16 schematically depicts a rod, and the arms connecting the rod to a nozzle ring in accordance with an embodiment of the present invention; and FIG. 17 schematically depicts an effect of the expansion of the nozzle ring on the position of the rod of FIG. 16, in accordance with an embodiment of the present invention.

FIG. 1 illustrates a known variable geometry turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet chamber 7 to an axial outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. When the nozzle ring 11 is proximate to the annular shroud 12, the vanes 14 project through suitably configured slots in the shroud 12, into the recess 13. In another embodiment (not shown), the wall of the inlet passageway may be provided with the vanes, and the nozzle ring provided with the recess and shroud.

The position of the nozzle ring 11 is controlled by an actuator assembly of the type disclosed in U.S. Pat. No. 5,868,552 referred to above. An actuator (not shown) is operable to adjust the position of the nozzle ring 11 via an actuator output shaft (not shown), which is linked to a yoke 15. The yoke 15 in turn engages axially extending moveable rods 16 that support the nozzle ring 11. Accordingly, by appropriate control of the actuator (which may for instance be pneumatic or electric), the axial position of the rods 16 and thus of the nozzle ring 11 can be controlled.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet chamber 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the face 10 of the nozzle ring 11 towards the shroud 12.

FIG. 2 illustrates components of a nozzle ring and nozzle ring actuator assembly of the general type shown in FIG. 1. These components are shown removed from the turbocharger for clarity. Specifically, FIG. 2 shows the backside of the nozzle ring 11 (facing away from the turbine inlet) supported on rods 16 mounted within bushes 24 for movement parallel to the axis of the turbocharger. Each arm of yoke 15 is connected to a respective rod 16 via a pivot pin 25 (only one of which is visible in FIG. 2) and sliding block 26. Each pivot pin 25 pivotally connects an end of an arm of the yoke 15 to a respective sliding block 26 which is received within a slot defined in the respective support rod 16. The yoke 15 is clamped to a yoke shaft 27 by bolt 28. The yoke shaft 27 is rotatably supported within bearings 29 which are mounted in the bearing housing wall (the bearing housing is not shown in FIG. 2). One end of the yoke shaft 27 is formed with a crank 30 appropriate for connection to an actuator. In the example illustrated in FIG. 2 the crank 30 is a sector gear suitable for connection to a gear wheel assembly driven by a rotary electric actuator (not shown).

In operation, rotary motion of the electric actuator is transferred to the crank 30 which rotates the yoke shaft 27 about its axis within the bushes 29. This in turn rotates the yoke 15 causing the pins 25 to describe an arc of a circle. This causes the blocks 26 to move axially with the rods 16, whilst sliding within the slots to accommodate off axis movement of the pins 25. The nozzle ring 11 is thereby moved along the axis of the turbocharger by rotation of the yoke 15.

FIG. 3 is a plan view schematically depicting the nozzle ring 11, rods 16 and bushes 24 of FIG. 2. A first end of each rod 16 is connected to the nozzle ring 11. A second end of each rod 16, remote from the first end, is provided with a slot 32 for connecting the rods to part of the actuator assembly shown in and described with reference to FIG. 2.

FIG. 4 schematically depicts the same plan view as shown in and described with reference to FIG. 3. However, in FIG. 4 the nozzle ring 11 is shown as expanding under the influence of heat, for example caused by the presence or flow of hot gases or the like. The expansion of the nozzle ring 11 is generically depicted by arrows 34. The expansion 34 of the nozzle ring 11 causes the rods 16 attached to the nozzle ring 11 to be pushed apart from one another, as depicted by arrows 36. When the rods 16 are pushed apart from one another 36 due to the expansion 34 of the nozzle ring 11, problems can be encountered. These problems are described with reference to FIGS. 5 and 6. These problems might arise even when each rod 16 moves only 0.6 mm, which is typical movement of the rod 16 during expansion of the nozzle ring 11.

FIG. 5 schematically depicts a cross sectional view of a bush 24 and a rod 16 extending through that bush 24. The rod 16 extends parallel to a longitudinal axis of the bush 24 such that the rod 16 may move smoothly through the bush 24. When the nozzle ring to which the rod 16 is attached expands, the rod 16 no longer extends through the bush 24 in a direction parallel to a longitudinal axis of the bush 24. Instead, as depicted in FIG. 6, the rod 16 extends through the bush 24 at an angle to a longitudinal axis of the bush 24. This means that the rod 16 is not well aligned with the bush 24 and may come into contact with and push against one or more surfaces of the bush 24. The load in the radial direction on the bush 24 may be, for example, 15 N to 350 N. Such pushing against the bush 24 can cause damage to the rod 16 or the bush 24. Alternatively or additionally, because the rod 16 is not well aligned with the bush 24, the rod 16 may become jammed within the bush 24. This may mean that it is no longer possible to move the nozzle ring to which the rod is attached. This is undesirable.

The problems described above have been described with reference to a rod extending through a bush. The problems are also applicable to the rod extending through or along any appropriate guide. The guide may be, as described above, a bush for supporting the rod and/or guiding movement of the rod. Alternatively or additionally, a guide may be a bore provided in a bearing housing through which a rod extends.

FIGS. 7 and 8 schematically depicts an arrangement for attaching rods to a nozzle ring in a manner which obviates or mitigates at least one of the problems referred to above. FIGS. 7 and 8 will be referred to in combination. FIG. 7 schematically depicts an end-on view of a nozzle ring 40, rods 42 and an arrangement for connecting the rods 42 to the nozzle ring 40. FIG. 8 is a perspective view of the nozzle ring 40, rods 42 and arrangement for attaching the rods 42 to a nozzle ring 40, as shown in FIG. 7.

A first end of each rod 42 is connected to the nozzle ring 40 via a first arm 44 and a second arm 46. A first end of each first arm 44 and a first end of each second arm 46 is attached to the rod 42. A second end of the first arm 44 and a second end of the second arm 46 is attached to the nozzle ring 40. The second end of the first arm 44 is attached to the nozzle ring at a first circumferential position, and a second end of a second arm is attached to the nozzle ring at a second, different circumferential position. The first arm 44 is substantially the same as the second arm 46.

Each rod 42 is located such that, when the turbine is not in use (i.e. when the nozzle ring 40 is not expanding), a longitudinal axis of each rod 42 extends between a radially outer extent of the nozzle ring 40 and a radially inner extent of the nozzle ring 40. FIG. 8 shows that the rods 42 extend through the guides 48, which in this embodiment take the form of bushes 48.

The angle between the rod 42 and the second end of each arm 44, 46 that is attached to the nozzle ring 40, with respect to a centre of the nozzle ring, may be any suitable angle. For instance, an angle of 60° to 90° is known to provide good performance.

Each first arm 44 and each second arm 46 is resilient in nature. The resilience of the arms 44, 46 permits relative movement between the first end of the rod 42 to which the arms 44, 46 are attached and the nozzle ring 40 during expansion of the nozzle ring 40. The resilience of the arms 44, 46 also ensures the arms 44, 46 return to their initial shape when the nozzle ring 40 returns to its initial shape. In functional terms (and as will be described in more detail below), each first arm 44 and each second arm 46 is configured such that any movement of the first end of the rod 42 in a direction of expansion of the nozzle ring 40, is less than the movement of the first end of the rod 42 would be if the rod 42 was directly attached to the nozzle ring 40.

FIG. 9 schematically depicts a perspective view of the arrangement for attaching the rods to the nozzle ring. The arrangement takes the form of a bracket 48. The bracket comprises the first arm 44 and the second arm 46 shown in and described with reference to FIGS. 7 and 8. A first end of the first arm 44 and a first end of the second arm 46 come together to form a channel 50. The channel 50 is shaped to receive a portion of the rod, so that the rod may be attached to the bracket 48 via the channel 50, for example by one or more forms of welding or the like. The second end of the first arm 44 and the second end of the second arm 46 is provided with a protrusion 52. Each protrusion 52 facilitates the connection of the second end of each arm 44, 46 to the nozzle ring (e.g. via one or more apertures or recesses provided in the nozzle ring), for example by one or more forms of welding or the like. The arms 44, 46 may alternatively be attached to the nozzle ring in any suitable manner, for example by riveting or the like. The arms 44, 46 may be attached to any suitable part of the nozzle ring. The arms 44, 46 may be attached to the nozzle ring using via a hinge arrangement, which may provide further flexibility and further reduce movement of the rod during expansion of the nozzle ring.

In the remaining part of this description, reference will be made to a plane having a particular orientation. The plane will be described as extending perpendicularly with respect to the turbine axis. In FIG. 7, this plane will be the plane in which the nozzle ring lies, or a plane parallel to the plane in which the nozzle ring lies.

Referring back to FIG. 9, each arm 44, 46 comprises a curve, or in other words a bend. The curve or bend facilitates the flexing or bending of each arm 44, 46 to allow relative movement between the first end of the rod and the nozzle ring during expansion of the nozzle ring. The curve or bend extends in a direction that is parallel to a plane that extends perpendicularly with respect to the turbine axis. This configuration may, alternatively or additionally, be described as the curve or bend propagating in a direction that is parallel to a plane which extends perpendicularly with respect to the turbine axis. Each curve or bend is curved or bent relative to a curve or bend axis. The curve or bend axis extends substantially parallel to the turbine axis. This means that, for example, a trough or crest of the curve or bend also extends parallel to the turbine axis. This gives each curve or bend in the arm 44, 46 rigidity in a direction parallel to the turbine axis, but allows flexibility in a direction that is parallel to a plane that extends perpendicularly with respect to that turbine axis. Referring back to FIG. 8, it can be seen that a result of the configuration of the first arm 44 and second arm 46 is that each arm 44, 46 extends substantially in a circumferential direction with respect to the nozzle ring 40.

Reference is again made to FIG. 8. Due to the direction in which the bend of each arm 44, 46 propagates, the first arm 44 and second arm 46 are extendable in a direction that is parallel to a plane that extends perpendicularly with respect to the turbine axis. Furthermore, the direction of propagation of the curve or bend of each arm 44, 46 is also parallel to that plane. Furthermore, the axis about which the curve or bend extends is substantially parallel to the turbine axis. Together, this means that the first arm 44 and second arm 46 are more extendable in a direction that is parallel to a plane that extends perpendicularly with respect to the turbine axis, than in a direction toward or away from that plane. This may alternatively or additionally be described as the first arm 44 and second arm 46 being stiffer in a direction parallel to the turbine axis than they are in a direction that is parallel to a plane that extends perpendicularly with respect to that turbine axis.

Referring to FIGS. 8 and 9, the first arm 44 and second arm 46 each have a length in a direction that is parallel to a plane that extends perpendicularly with respect to the turbine axis. This is generally the length of extension of the first arm 44 and second arm 46 between the point of fixation of each arm 44, 46 to the nozzle ring 40 and the rod 42 to which each arm 44, 46 is attached. Each arm 44, 46 also has a width in a direction parallel to the turbine axis, and a depth which is perpendicular to both the length and the width of each arm 44, 46. In order to facilitate flexibility in a direction parallel to a plane that extends perpendicularly with respect to the turbine axis, but promote or ensure rigidity or stiffness in a direction parallel to the turbine axis, the width of each arm 44, 46 is greater than the depth of each arm 44, 46. The depth of each arm 44, 46 may be, for example, 0.6 mm to 1.6 mm.

The advantageous nature of the manner in which each rod is connected to the nozzle ring via first and second arms will now be described with reference to FIGS. 10 and 11.

FIGS. 10 and 11 schematically depict end-on views of the nozzle ring 40, rods 42 and first and second arms 44, 46 attaching each rod 42 to the nozzle ring 40. FIG. 10 shows the nozzle ring 40 in a first configuration. FIG. 11 shows the nozzle ring 40 in a second, expanded configuration. The expansion of the nozzle ring 40 has been caused due to heating of the nozzle ring 40, for example due to heated gases in the vicinity of the nozzle ring 40. The degree of expansion is shown schematically (and in exaggerated form, for clarity) by way of arrows 54.

Despite the expansion of the nozzle ring 40, the position of each rod 42 remains substantially unchanged. This is because, during expansion of the nozzle ring 40, the arms 44, 46, being flexible and resilient in nature, at least partially accommodate for the expansion of the nozzle ring 40 and thus keep the rod 42 in substantially the same position. In this embodiment, this is achieved by the bends in the arms 44, 46 becoming flattened during the expansion of the nozzle ring 40. The flattening of the bends of the arms 44, 46, may alternatively or additionally be described as bending of the arms 44, 46. Bending of the arms 44, 46 occurs in a direction opposite to that of the inherent bended shape of each arm 44, 46, such that each arm 44, 46 is flattened.

FIG. 12 schematically depicts a plan view of the nozzle ring 40, rods 42 and bushes 48 shown in and described with reference to FIGS. 7 to 11. Referring back to FIG. 12, expansion of the nozzle ring 40 is schematically depicted by way of arrows 56. In this embodiment, however, expansion 46 of the nozzle ring 40 does not push the rods 42 away from one another. This is due to the principles shown in and described with reference to FIGS. 10 and 11—i.e. the rods 42 remain substantially in the same position during expansion of the nozzle ring 40. Because the rods 42 remain substantially in the same position during expansion of the nozzle ring 40, the chances of the rods 42 rubbing against and/or becoming jammed within guides of the rod during such expansion are reduced or eliminated.

Previous attempts have been made to overcome the problem of rods being pushed apart from one another during expansion of the nozzle ring. In one example, each rod is attached to the nozzle ring via a sliding arrangement which accommodates the expansion of the nozzle ring and allows the rods to be kept substantially in the same position. However, in this example, the rods are known to rotate slightly as the nozzle ring expands. Such rotation is undesirable, since the rotation may interfere with elements of an actuator assembly which is used to axially move the rods. Embodiments of the present invention obviate or mitigate the problem of the rods being pushed apart from one another during expansion of the nozzle ring, and without the associated disadvantage of the rods rotating slightly. As well as overcoming problems that such rotation may cause in, for example, the actuator assembly used to axially move the rods, the embodiment of the invention may be further improved because no rotation of the rods occurs.

FIG. 13 schematically depicts the same plan view shown in and described with reference to FIG. 12, but without reference to the expansion of the nozzle ring. In this embodiment, a bridge 58 is shown as connecting two rods 42 together. The bridge 58 adds a further degree of rigidity to the arrangement as a whole, and, for example, prevents or inhibits the rods 42 moving apart from one another. The bridge thereby further obviates or mitigates the problems of the rods 42 rubbing against and damaging the bushes 48, or becoming jammed within the bushes 48. It will be appreciated that such a bridge 58 could not be used if the rods rotated in use.

As described above, it is advantageous to attach the rods for supporting a nozzle ring to that nozzle ring by way of first and second resilient arms which extend away from the rod, and which are attached to the nozzle ring at different circumferential positions about the nozzle ring. This allows relative movement between the first end of the rod and the nozzle ring during expansion of the nozzle ring. The movement of the rod in a direction of expansion of the nozzle ring is less than the movement would be if the rod was directly attached to the nozzle ring. Movement of the first end of the rod during expansion of the nozzle ring can be further reduced by appropriate selection of the materials forming the first and second arms which attach the rod to a nozzle ring, with reference to the material or materials which form the nozzle ring. In particular, the movement of the first end of the rod can be further reduced by forming the first arm and second arm from a material which has a lower coefficient of thermal expansion than the material forming the nozzle ring. FIGS. 14 to 17 schematically depict the principles behind this embodiment of the present invention.

FIG. 14 schematically depicts an end on view of a rod 42. Resilient arms 60 are shown as being attached to and extending away from the rod 42. Ends of the arms 60 remote from the rod 42 are attached to the nozzle ring (nozzle ring not shown, for clarity). The arms 60 are formed from a material which has substantially the same coefficient of thermal expansion as the material forming the nozzle ring. The distance between the ends of the arms 60 remote from the rod 42 is defined as W1.

FIG. 15 schematically depicts the arrangement of FIG. 14 but in an expanded state, due to heating of the nozzle ring to which the arms 60 are attached. The expansion of the nozzle ring has caused the distance between the ends of the arms 60 remote from the rod 42 to increase from a distance W1 (shown in FIGS. 15) to W2. Furthermore, due to the thermal expansion of the nozzle ring, the arms 60, being in contact with the nozzle ring, will also become heated and expand. The expansion of the arms 60 results in the position of the rod 42 being shifted (upwards, as shown in the Figure), as depicted by arrows SH.

The expansion SH has been shown in an exaggerated manner in FIGS. 15 and 16 to assist in the understanding of the embodiment of the present invention. The shift SH shown in FIG. 15 does not imply that the resilient arms (regardless of their composition) provide no benefit during the expansion of the nozzle ring. It will be appreciated that is desirable to reduce or eliminate any shift SH in the position of the rods 42 during the expansion from the nozzle ring, however small.

FIG. 16 shows substantially the same arrangement as shown in and described with reference to FIG. 15. However, in FIG. 16, the arms 62 of the arrangement are formed from a material which has a lower coefficient of thermal expansion than a material forming the nozzle ring. The coefficient of thermal expansion of the material forming the arms 62 may be 5-60% less than that of the material forming the nozzle ring. The coefficient of thermal expansion of the material forming the arms 62 may be 15-40% less than that of the material forming the nozzle ring. If the coefficient of thermal expansion of the material forming the arms 62 was any lower, the fatigue in one or more joints between the arms and the nozzle ring may be too high.

FIG. 17 shows expansion of the nozzle ring, which results in a distance between the ends of the arms 62 remote from the rod 42 increasing from a distance of W1 to a distance of W2. Because the arms 62 are formed from a material which has a lower coefficient of thermal expansion than the material forming the nozzle ring, the arms 62 do not expand as much as the nozzle ring. Since the arms 62 do not expand as much as the nozzle ring, and do not expand as much as was shown in relation to the arms of FIG. 15, the position of the rod 42 does not shift as much as was shown in FIG. 15. This reduced expansion of the arms 62 obviates or mitigates the problems that are associated with movement of the rods during the expansion of the nozzle ring. This reduced expansion can be seen, in a diagrammatic form, by comparing triangles shown in dashed lines in FIGS. 14 to 17, and which extend between the mid-point of the end of the rod 42 and the ends of the arms 60, 62 remote from the rod 42. In particular, by comparing the triangles shown in FIGS. 15 and 17, it can be seen that the triangle in FIG. 17 is flattened in comparison with the triangle of FIG. 15. This is due to the choice of material for the arm 62 of FIG. 17. The flattening of the triangle in FIG. 17 results in the reduction or illumination in the shift of position of the rod 42 during expansion of the nozzle ring.

The angle of the apex of the triangle adjacent to the rod 42 gives an indication of the position of the rod 42 relative to the ends of the arms 62 that are remote from the rod 42. When not in use, this angle may, for example, be 90°. A flatter triangle would be a triangle in which this apex angle was greater then 90°. Increasing this angle may reduce the stress on the arms, for example the stress that acts away from the nozzle ring in a direction parallel to the turbine axis. The angle of this apex may be, for example 100°-180° (180° being when the rod 42 and ends of the arms 62 that are remote from the rod 42 lie in a straight line), 130°-180° or 140°-179°.

It will be appreciated that resilient arms connecting the rods to the nozzle ring may comprise one or more bends. It will be appreciated that the arms connecting the rod to the nozzle ring may be formed from a material which has a lower coefficient of thermal expansion than a material forming the nozzle ring. In a preferable embodiment, the arms comprise one or more bends and are also formed from a material which has a lower coefficient of thermal expansion than a material forming the annular member. This results in the advantages described above in relation to each independent embodiment being combined to further reduce or eliminate the positional shift of the rods away from one another during expansion of the nozzle ring.

In the embodiments described above, the arms connecting the rods to the nozzle ring have been described as being joined together to form a single bracket. In another example, the arms may be formed in an independent form and independently attached to the nozzle ring and the rod. In either embodiment, the arms may be formed in any suitable manner, for example by metal injection moulding. The arms may be formed from any suitable metal or alloy which can withstand the temperatures that the arms would, in use, be exposed to. The arms may be formed, for example, from stainless steel 304L. The nozzle ring may also be formed, for example, from stainless steel 304L. In another example, the arms may be formed, for example, from stainless steel 17-4PH. In yet another example, the arms may be formed, for example, from a nickel based alloy, for instance suitable alloys under the brand name inconel™.

In the above-mentioned embodiments, the terms 'bend' and 'curve' have been used. It will be understood that these terms, and in particular the use of the term 'bend' encompasses folds in the or each arm. In the above-mentioned embodiments, a single curve or bend is shown in each arm. More than one bend or curve can be formed in each arm. The one or more bends or curves may extend along the full length of each arm, which may improve the flexibility of the arm and the ability of the arm to accommodate for expansion of the nozzle ring. In an alternative embodiment, one or more bends or curves can be formed in localised regions of the arm, for example in the centre of the arm, or in or adjacent to regions where the arms are attached to the rod or the nozzle ring.

Whilst the invention has been illustrated in its application to the turbine of a turbocharger, it will be appreciated that the invention can be applied to variable geometry turbines in other applications.

Other possible modifications to the detailed structure of the illustrated embodiment of the invention will be readily apparent to the appropriately skilled person. Various modifications may be made to the embodiments of the invention described above, without departing from the present invention as defined by the claims that follow.

The invention claimed is:

1. A variable geometry turbine comprising:

a turbine wheel mounted on a turbine shaft within a housing assembly for rotation about a turbine axis, the housing assembly defining a gas flow inlet passage upstream of the turbine wheel;

an annular wall member defining a wall of the inlet passage and which is displaceable in a direction substantially parallel to the turbine axis to control gas flow through the inlet passage;

at least one moveable rod operably connected via a first end of the rod to the annular wall member, the rod being moveable to control displacement of the annular wall member, the rod extending in a direction substantially parallel to the turbine axis, the rod being connected to the annular wall member via a first arm and a second arm, a first end of the first arm and a first end of the second arm being attached to the rod, and a second end of the first arm being attached to the annular wall member at a first circumferential position, and a second end of the second arm being attached to the annular wall member at a second, different circumferential position, the first arm and the second arm being resilient in order to allow relative movement between the first end of the rod and the annular wall member during expansion of the annular wall member.

2. The turbine as claimed in claim 1, wherein the first arm and second arm are configured such that any movement of the first end of the rod in a direction of expansion of the annular wall member is less than the movement would be if the rod was directly attached to the annular wall member.

3. The turbine as claimed in claim 1, wherein the first arm and second arm are formed from a material which has a lower coefficient of thermal expansion than a material forming the annular wall member.

4. The turbine as claimed in claim 1, wherein the annular wall member extends in a direction parallel to a plane that extends perpendicularly with respect to the turbine axis.

5. The turbine as claimed in claim 1, wherein the first arm and the second arm extend in a direction that is parallel to a plane that extends perpendicularly with respect to the turbine axis.

6. The turbine as claimed in claim 1, wherein the first arm and the second arm are extendable in a direction that is parallel to a plane that extends perpendicularly with respect to the turbine axis.

7. The turbine as claimed in claim 1, wherein the first arm and second arm are configured to be more extendable in a direction that is parallel to a plane that extends perpendicularly with respect to the turbine axis, than in a direction toward or away from that plane.

8. The turbine as claimed in claim 1, wherein the first arm and second arm are stiffer in a direction parallel to the turbine axis than the first arm and second arm are in a direction that is parallel to a plane that extends perpendicularly with respect to the turbine axis.

9. The turbine as claimed in claim 1, where the first arm and second arm each have a length in a direction that is parallel to a plane that extends perpendicularly with respect to the turbine axis, a width in a direction parallel to the turbine axis, and a depth perpendicular to the length and width, the width being greater than the depth.

10. The turbine as claimed in claim 1, wherein the first arm and second arm each comprise a curve or a bend.

11. The turbine as claimed in claim 10, wherein the curve or bend extends in a direction that is parallel to a plane that extends perpendicularly with respect to the turbine axis.

12. The turbine as claimed in claim 11, wherein the curve or bend is curved or bent relative to a curve or bend axis, the curve or bend axis extending substantially parallel to the turbine axis.

13. The turbine as claimed in claim 1, wherein the first arm and second arm extend in a substantially circumferential direction with respect to the annular wall member.

14. The turbine as claimed in claim 1, wherein the rod is located such that, when the turbine is not in use, a longitudinal axis of the rod extends between a radially outer extent of the annular wall member and a radially inner extent of the annular wall member.

15. The turbine as claimed in claim 1, wherein the first arm and second arm are substantially the same.

16. The turbine as claimed in claim 1, wherein the arms are joined together.

17. The turbine as claimed in claim 1, wherein the turbine comprises a guide configured to guide movement of the rod, and/or to support the rod.

18. The turbine as claimed in claim 17, wherein the guide defines an aperture through which the rod is moveable.

19. The turbine as claimed in claim 1, wherein two rods are provided, each rod being connected to the annular wall member via a first arm and a second arm, a first end of the first arm and a first end of the second arm being attached to the rod, and a second end of the first arm being attached to the annular wall member at a first circumferential position, and a second end of the second arm being attached to the annular wall member at a second, different circumferential position.

20. The turbine as claimed in claim 19, wherein the two rods are connected to the annular wall member such that the two rods are diametrically opposed with respect to one another.

21. The turbine as claimed in claim 19, wherein a bridge is provided that connects the two rods.

22. The turbine as claimed in claim 1, wherein the turbine forms part of a turbocharger.

* * * * *